US005876562A

United States Patent [19]

Johansson

[11] Patent Number: 5,876,562

[45] Date of Patent: Mar. 2, 1999

[54] SIZING DISPERSIONS

[75] Inventor: Hans Johansson, Kungälv, Sweden

[73] Assignee: Eka Chemicals AB, Bohus, Sweden

[21] Appl. No.: 849,180

[22] PCT Filed: Dec. 1, 1995

[86] PCT No.: PCT/SE95/01446

§ 371 Date: May 28, 1997

§ 102(e) Date: May 28, 1997

[87] PCT Pub. No.: WO96/17127

PCT Pub. Date: Jun. 6, 1996

[30] Foreign Application Priority Data

Dec. 2, 1994 [SE] Sweden ..... 9404201

[51] Int. Cl.[6] ..... D21H 21/16

[52] U.S. Cl. ..... 162/158; 162/135; 162/168.2; 162/168.3; 162/175; 162/178; 162/179; 162/181.6; 106/287.2; 106/287.17; 106/287.23; 106/287.24; 106/287.25

[58] Field of Search ..... 162/135, 158, 162/179, 181.6, 175, 178, 168.3, 168.2; 106/287.23, 287.24, 287.25, 287.2, 287.17; 252/8.83, 310; 8/116.1, 181, 192

[56] References Cited

U.S. PATENT DOCUMENTS

| | | | |
|---|---|---|---|
| 2,865,743 | 12/1958 | Weisgerber | 92/3 |
| 3,887,427 | 6/1975 | Helmer et al. | 162/158 |
| 4,522,686 | 6/1985 | Dumas | 162/158 |
| 4,849,055 | 7/1989 | Yoshioka et al. | 162/158 |
| 4,961,825 | 10/1990 | Andersson et al. | 162/175 |
| 4,980,025 | 12/1990 | Andersson et al. | 162/168.3 |
| 5,368,833 | 11/1994 | Johansson et al. | 423/338 |

FOREIGN PATENT DOCUMENTS

| | | | |
|---|---|---|---|
| 0 418 015 | 3/1991 | European Pat. Off. | D21H 17/17 |
| 0 445 953 | 9/1991 | European Pat. Off. | D21H 17/69 |
| 0 564 994 | 10/1992 | European Pat. Off. | D21H 17/17 |
| WO 94/05596 | 3/1994 | WIPO | C01B 33/143 |

*Primary Examiner*—Peter Chin
*Attorney, Agent, or Firm*—Ralph J. Mancini

[57] ABSTRACT

An aqueous anionic sizing dispersion which comprises an anionic dispersion of a cellulose-reactive sizing agent and colloidal anionic aluminum modified silica-based particles. The dispersion is used in the production of paper, board or cardboard whereby the dispersion is either added to the stock or applied as a surface size.

16 Claims, No Drawings

SIZING DISPERSIONS

The present invention relates to anionic sizing dispersions and more particularly to such dispersions which comprise an anionic dispersion of a cellulose-reactive sizing agent and colloidal anionic aluminum-modified silica particles.

Aqueous dispersions of cellulose-reactive sizing agents, like alkyl ketene dimer (AKD) and alkenyl succinic anhydride (ASA), are widely used for sizing at neutral or slightly alkaline pH levels in order to impart liquid repellent or hydrophobic properties to cellulose-based products. Anionically stabilized dispersions are usually used in stock sizing applications involving high levels of cationic charge, for example as a result of cationic papermaking aids added to the stock, where retention of cationically stabilized dispersions has proved problematic. Such highly cationic wet-end systems are used for instance in the production of liquid packaging board and for photographic paper.

Commercial anionic AKD dispersions are sufficiently stable to permit transportation, storage and usage. In order to maximize shelf life and sizing efficiency, the dispersions are kept at low temperatures, without being allowed to freeze, and the products usually have a shelf life of at least one month at room temperature. However, there have been examples of agglomeration and separation of storage-stable anionic AKD dispersions when subjected to high shear forces, in particular at pumping and mixing operations. The agglomeration and separation has resulted in deposition problems, an increased need of maintenance and difficulty in dosing the dispersion.

It is known from EP 564994 to incorporate alum in sizing compositions of cationic ketene dimers and cationic colloidal silica, alumina or zirconia in order to aid in stabilization.

The object of these compositions is to achieve the desired level of sizing while increasing the coefficient of friction of the paper surface.

EP 418 015 discloses sizing compositions comprising a ketene dimer and an anionic dispersing agent. In addition, an extender or modifyer such as an anionic polyacrylamide, an anionic starch or colloidal silica can be present to extend or modify the anionic charge density of the compositions.

According to the present invention it has been found that the stability of anionic dispersions of cellulose-reactive sizing agents can be improved by the incorporation of colloidal anionic aluminum-modified silica particles. The anionic sizing dispersions according to the invention have less tendency to agglomerate and form deposits when subjected to shear forces and show very good shelf life at storage temperatures usually employed. In comparison with anionic sizing dispersions containing colloidal silica particles, the present dispersions comprising colloidal anionic particles of aluminum-modified silica show improved stability. Introducing aluminum-modified silica particles into the anionic sizing dispersions also results in a very good sizing with low amounts of the sizing agent when used in stock systems where high levels of cationic charge are evident, for example resulting from cationic wet-strength resins, cationic starches, polyacrylamides and polyethyleneimines added to the stock, since a very good retention of the sizing agent is obtained.

The present invention thus relates to aqueous anionic sizing dispersions as further defined in the claims.

The cellulose-reactive sizing agent which is present in the dispersions according to the invention can be selected from any of the cellulose-reactive sizing agents known in the art. Suitably, the cellulose-reactive sizing agent is selected from the group consisting of hydrophobic ketene dimers, acid anhydrides, organic isocyanates, carbamoyl chlorides and mixtures thereof, preferably ketene dimers and acid anhydrides, most preferably ketene dimers.

Suitable ketene dimers have the formula (I) shown below, in which $R^1$ and $R^2$ represent hydrocarbon groups suitably having from 8 to 36 carbon atoms, usually being alkyl groups having 12 to 20 carbon atoms, such as hexadecyl and octadecyl groups. Suitable acid anhydrides can be characterized by the general formula (II) shown below, in which $R^3$ and $R^4$ can be identical or different and represent saturated or unsaturated hydrocarbon groups suitably containing from 8 to 30 carbon atoms, or $R^3$ and $R^4$ together with the —C—O—C— moiety can form a 5 to 6 membered ring, which can be substituted with hydrocarbon groups containing up to 30 carbon atoms. Examples of acid anhydrides which are used commercially include alkyl and alkenyl succinic anhydrides (ASA) and particularly isooctadecenyl succinic anhydride.

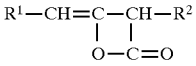

(I)

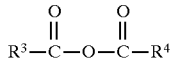

(II)

Suitable ketene dimers, acid anhydrides and organic isocyanates include the compounds disclosed in U.S. Pat. No. 4,522,686, which is hereby incorporated herein by reference. Examples of suitable carbamoyl chlorides include those disclosed in U.S. Pat. No. 3,887,427 which is also incorporated herein by reference.

The sizing dispersions according to the invention comprise colloidal anionic aluminum-modified silica particles. The term colloidal anionic aluminum-modified silica particles used herein is meant to include colloidal anionic particles having at least a surface layer of aluminum silicate, including pure aluminum silicates, and colloidal anionic particles of silicic acid or silica which are surface-modified with aluminum. It is preferred that the particles are surface-modified with aluminum. Colloidal anionic particles of the above-mentioned types which can be present in the the dispersions according to the invention are known in the art, for example from U.S. Pat. No. 4,961,825, U.S. Pat. No. 4,980,025, U.S. Pat. No. 5,368,833 and WO 94/05596, which are hereby incorporated herein by reference. The colloidal particles are usually contained in aqueous sols. The aluminum-modified particles are suitably surface-modified with aluminum to a degree of 2 to 25% and preferably from 3 to 20%, and hereby is meant the number of aluminum atoms which has replaced silicon atoms in the particle surface. The degree of modification is given in % and is calculated on basis of 8 silanol groups per $nm^2$, as described by Iler, R. K. in Journal of Colloidal and Interface Science, 55(1976):1, 25–34. The colloidal anionic aluminum-modified silica particles can have a size less than about 500 nm and the size is usually greater than 1.5 nm, corresponding to a specific surface area in the range of about 5 to about 1800 $m^2/g$. Suitably, the particle size is in the range of from about 2.5 to about 270 nm, corresponding to a specific surface area in the range of from about 10 to about 1000 $m^2/g$. Preferably, the specific surface area of the particles is from 30 to 950 $m^2/g$. The specific surface area can be measured by means of titration with NaOH in conventional manner, for example according to the method described by Sears in Analytical Chemistry 28(1956):12, 1981–1983.

Anionic dispersions according to the invention can have contents of cellulose-reactive sizing agents from about 0.1% by weight up to about 30% by weight. The content of cellulose-reactive sizing agent is suitably within the range of from 5 to 25% and preferably from 8 to 20% by weight.

In the dispersions according to the invention the weight ratio of cellulose-reactive sizing agent to aluminum-modified silica particles can be within the range of from 1:1 to 100:1. The weight ratio is suitably within the range 1.5:1 to 30:1 and preferably within the range 2:1 to 20:1. The solids content of the dispersions usually exceeds 1% by weight and can reach 50% by weight. The solids content suitably exceeds 5% by weight. The upper limit is suitably 40% and preferably 30% by weight.

The dispersions according to the present invention may contain one or several anionic dispersing agents in amounts which are sufficient to confer the desired negative charge to the dispersions. Suitably, the amount of dispersing agent is at least 0.5% by weight, based on the amount of sizing agent. Normally, it is not necessary to use more than 10% by weight.

The dispersing agents can be any of those conventionally used at the preparation of aqueous anionic sizing dispersions or emulsions. They can for example be selected from saponified rosin derivatives, alkyl sulphates, alkylaryl sulphates, alkyl sulphonates, alkylaryl sulphonates, etc. Particularly suitable anionic dispersing agents are alkyl sulphates and alkyl sulphonates, e.g. sodium lauryl sulphate, as well as sodium lignosulphonate and sodium naphthalene sulphonate.

If desired, non-ionic, anionic, amphoteric or cationic protective colloids and non-ionic, amphoteric or cationic dispersing agents may be included in the dispersions, preferably in minor amounts and provided that the overall charge of the total amount of dispersing agents and optional protective colloids which are present in the dispersions is negative or anionic. Such compounds may advantageously be included in disersions of higher dry contents. As examples of suitable protective colloids can be mentioned water-soluble cellulose-derivatives such as hydroxyethyl- and hydroxypropyl-, methylhydroxypropyl- and ethylhydroxyethylcellulose, methyl- and carboxymethylcellulose, gelatin, starch, guar gum, xanthan gum, polyvinyl alcohol, etc.. Non-ionic dispersing agents can for example be selected from ethoxylated fatty alcohols, fatty acids, alkyl phenols or fatty acid amides, ethoxylated or non-ethoxylated glycerol esters, sorbitan esters of fatty acids, etc. Suitable cationic dispersing agents and protective colloids can for example be selected from nitrogen-containing compounds such as quaternary ammonium compounds, salts of tertiary amines, water-soluble nitrogen-containing epichlorohydrin resins and cationic starches, etc.. The dispersion may also contain other additives such as preservative agents.

The dispersions according to the invention can for example be prepared by simply mixing an anionic dispersion or emulsion of a cellulose-reactive sizing agent with a sol of colloidal anionic aluminum-modified silica particles, such as any of those described above. Anionic dispersions of cellulose-reactive sizing agents and sols of colloidal anionic aluminum-modified silica particles are known in the art and commercially available.

The anionic dispersions according to the invention can be used in a conventional manner in the production of cellulose-based products, including paper, board and cardboard. They can be used both for surface sizing and internal or stock sizing at the production of such products. The present invention also relates to a method for the production of cellulose-based products using an aqueous anionic dispersion containing a cellulose-reactive sizing agent and colloidal anionic aluminum-modified silica particles, as defined above, as surface or stock sizing agents. The method is of course advantageous to the papermaker in that the sizing dispersion has high sizing efficiency and improved stability which reduces the tendency of the sizing agent to form deposits and thus simplifies high shearing operations such as pumping and dosing. Suitably, the amount of cellulose-reactive sizing agent either added to the stock containing cellulose fibers, and optional fillers, or applied on the cellulose-based product as a surface size, usually at the size press, is from 0.01 to 1.0%. by weight, based on the dry weight of cellulose fibers and optional fillers, preferably from 0.05 to 0.5% by weight, where the dosage is mainly dependent on the quality of the pulp or cellulose-based product to be sized, the cellulose-reactive sizing agent used and the level of sizing desired.

Chemicals conventionally added to the stock in papermaking such as retention aids, aluminum compounds, dyes, wet-strength resins, optical brightening agents, etc., can of course be used in conjunction with the present dispersions. Examples of suitable retention aids include cationic polymers, bentonite in combination with cationic polymers and silica-based sols in combination with cationic polymers or cationic and anionic polymers. Examples of aluminium compounds include alum, aluminates and polyaluminium compounds such as polyaluminium chlorides and sulphates.

Particularly good stock sizing can be obtained when using the dispersions of the invention in combination with cationic polymers. As examples of suitable cationic polymers can be mentioned cationic starch, guar gum, polyacrylamide, polyethyleneimine, polyamidoamine and poly(diallyldimethyl ammoniumchloride) and combinations thereof. Cationic starch and polyacrylamide are preferably used, either alone or in combination. When use is made of stocks containing high levels of so-called anionic trash, the addition to the stock of cationic polymers as mentioned above can be preceded by the addition of a low molecular weight cationic polymer in order to reduce the cationic demand of the stock. The present dispersions can be added before, between, after or simultaneously with the addition of the cationic polymer or polymers.

The invention is further illustrated in the following examples, which, however, are not intended to limit the same. Parts and % relate to parts by weight and % by weight, respectively, unless otherwise stated.

EXAMPLE 1

Anionic sizing dispersions were prepared by mixing an anionic ketene dimer dispersion with various sols of anionic silica-based particles. The following sols were used:

Sol A: A sol of colloidal anionic particles of aluminium-modified silicic acid having a specific surface area of 500 $m^2/g$ and being aluminum-modified to a degree of 9%, as disclosed in U.S. Pat. No. 4,961,825.

Sol B: A sol of colloidal anionic aluminium-modified silica particles having a specific surface area of 220 $m^2/g$ and being aluminum-modified to a degree of 5%, commercially available under the tradename Bindzil 305/220, Eka Nobel.

Sol C: A sol of colloidal silica particles having a specific surface area of 500 $m^2/g$, as disclosed in U.S. Pat. No. 4,388,150.

Sols A and B were used for preparing dispersions according to the invention whereas sol C was used for preparing dispersions for comparison purposes. In order to prepare the dispersions, the sols were diluted with water to a $SiO_2$ concentration of 15% by weight, acidified with $H_2SO_4$ to a pH of 3.5 and the obtained acid sols were mixed with an anionic ketene dimer dispersion (hereinafter designated Ref. AKD) having an AKD content of 9.6%, solids content of 10.7% and pH of 3.5, in amounts of 10 and 20% by weight (calculated as $SiO_2$ on dry ketene dimer), respectively. The following sizing dispersions were prepared: A10, A20, B10 and B20 according to the invention, and Ref. C10 and Ref. C20 for comparison purposes, the capitals A, B, C and FIGS. 10, 20 referring to the silica-based sol used and the amount thereof, respectively.

EXAMPLE 2

Stability of the anionic dispersions according to Example 1 was evaluated by means of an aggregation and deposition test, a so-called glass tube test, in which the dispersions after storage at 25° C. for 2–4 weeks were subjected to high shear forces for a set time before the evaluation.

In the glass tube test, the dispersion was placed in a glass tube which was sealed and then vigorously shaken for 15 minutes. The glass tube was inspected visually and the amount of deposition formed on the interior wall of the tube was correlated to the stability of the dispersion, which was expressed as good, fair or poor.

In addition, stability was tested by measuring the viscosity of the anionic dispersions according to Example 1 after storage at 40° C. for 2–4 weeks. The viscosity was measured with a Brookfield RTV viscosimeter (spindle no. 2, 50 rpm).

The results are set forth in the table below.

| Dispersion used | Storage (weeks) | Stability Glass Tube Test | Viscosity (cps) 40° C. |
|---|---|---|---|
| Ref. AKD | 2 | fair | 15 |
| Ref. AKD | 4 | poor | 16 |
| Ref. C10 | 2 | fair | 15 |
| Ref. C10 | 4 | fair | 16 |
| Ref. C20 | 2 | fair | 20 |
| Ref. C20 | 4 | poor | 72 |
| A10 | 2 | good | 16 |
| A10 | 4 | good | 16 |
| A20 | 2 | good | 17 |
| A20 | 4 | good | 16 |
| B10 | 2 | good | 17 |
| B10 | 4 | good | 16 |
| B20 | 2 | good | 16 |
| B20 | 4 | good | 18 |

As is evident from the table, the dispersions according to the invention containing colloidal anionic aluminum-modified silica particles showed improved stability as compared to the anionic ketene dimer dispersion from which they were prepared and the anionic ketene dimer dispersion containing colloidal silica.

EXAMPLE 3

The sizing efficiency of a dispersion according to invention was evaluated in this example. The dispersion was prepared in a manner similar to Example 1 from a sol having an S-value of 25% and containing colloidal anionic silica particles having a specific surface area of 900 $m^2/g$ which were surface-modified with aluminum to a degree of 5%, as disclosed in U.S. Pat. No. 4,961,825, and the anionic ketene dimer dispersion, Ref. AKD, used in Example 1. The content of silica-based particles was 30% by weight, calculated as $SiO_2$ on dry ketene dimer. The obtained sizing dispersion, designated D30, showed good stability after storage at 25° C. for one week, evaluated by means of the glass tube test described in Example 2.

Paper sheets were prepared from a standard stock of bleached sulphate pulp (60% birch and 40% pine) at a pH of 7.5 according to the standard method SCAN-C23X for laboratory scale. The dispersion Ref. AKD was used for comparison purposes. The dispersions were added to the stock in amounts of 0.5, 1.0 and 2.0 kg/tonne, respectively, calculated as ketene dimer sizing agent on dry cellulose fibres, followed by the addition of 6 kg/tonne of cationic potato starch. The obtained Cobb-values, measured according to Tappi standard T 441 OS-63, are shown in the table below.

| Dispersion used | AKD dosage (kp/tonne) | Cobb 60 ($g/m^2$) |
|---|---|---|
| Ref. AKD | 0.5 | 29.0 |
| Ref. AKD | 1.0 | 22.0 |
| Ref. AKD | 2.0 | 20.5 |
| D30 | 0.5 | 19.5 |
| D30 | 1.0 | 18.5 |
| D30 | 2.0 | 17.0 |

As can be seen, the dispersion according to the invention showed very high sizing efficiency.

I claim:

1. Aqueous anionic sizing dispersion which comprises an anionic dispersion of a cellulose-reactive sizing agent selected from the group consisting of hydrophobic ketene dimers; acid anhydrides, organic isocyanates, carbamoyl chlorides and mixtures thereof, and colloidal anionic aluminum-modified silica particles wherein the ratio of cellulose-reactive sizing agent and aluminum-modified silica particles is in the range of from 1:1 to 100:1, and the solids content of the dispersion is from 1 to 50% by weight.

2. Sizing dispersion according to claim 1 wherein the weight ratio of cellulose-reactive sizing agent to aluminum-modified silica particles is in the range of from 2:1 to 20:1.

3. Sizing dispersion according to claim 1 wherein the aluminum-modified silica particles have a size less than 500 mn.

4. Sizing dispersion according to claim 1 wherein the aluminum-modified silica particles have a specific surface area within the range of from 10 to 1000 $m^2/g$.

5. Sizing dispersion according to claim 1 wherein the cellulose-reactive sizing agent is present in an amount of from 0.1% by weight to 30% by weight.

6. Sizing dispersion according to claim 1 wherein the cellulose-reactive sizing agent is an alkyl ketene dimer.

7. Sizing dispersion according to claim 1 wherein the aluminum-modified silica particles are selected from the group consisting of particles having at least a surface layer of aluminum silicate and silica particles which are surface modified with aluminum.

8. The sizing dispersion of claim 1 wherein the cellulose reactive sizing agent is a hydrophobic acid anhydride.

9. The sizing dispersion of claim 1 which comprises at lease one anionic dispersing agent.

10. The sizing dispersion of claim 9 which comprises at lease 0.5% by weight anionic dispersing agent based on the amount of sizing agent.

11. The sizing dispersion of claim 1 wherein said ketene dimer is of the formula:

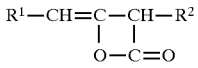

I)

wherein $R^1$ and $R^2$ are hydrocarbon groups having from 8–36 carbon atoms.

12. The sizing dispersion of claim 1 wherein the sizing agent is present in an amount of from 5 to 25% by weight.

13. A process for the production of cellulose-based products which comprises adding to said cellulose-based product, an aqueous anionic sizing dispersion which comprises an anionic dispersion of a cellulose-reactive sizing agent selected from the group consisting of hydrophobic ketene dimers; acid anhydrides, organic isocyanates, carbamoyl chlorides and mixtures thereof, and colloidal anionic aluminum-modified silica particles wherein the ratio of cellulose-reactive sizing agent and aluminum-modified silica particles is in the range of from 1:1 to 100:1, and the solids content of the dispersion is from 1 to 50% by weight.

14. A process according to claim 13, wherein the cellulose-based products comprise paper, board and cardboard.

15. The process of claim 13 wherein said aqueous sizing dispersion is either added to the cellulose stock or is applied as a surface size.

16. The process of claim 15 wherein the aqueous sizing dispersion is added to the stock in combination with a cationic polymer selected from cationic starch, guar gum, polyacrylamide, polyethyleneimine, polyamidoamine and poly(diallyldimethyl ammoniumchloride) and combinations thereof.

* * * * *